US009819106B2

(12) United States Patent
Froebing

(10) Patent No.: US 9,819,106 B2
(45) Date of Patent: Nov. 14, 2017

(54) MALE STRIP CONNECTOR

(71) Applicant: WAGO Verwaltungsgesellschaft mbH, Minden (DE)

(72) Inventor: Jens Froebing, Gotha (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 15/516,258

(22) PCT Filed: Sep. 23, 2015

(86) PCT No.: PCT/EP2015/071882
§ 371 (c)(1),
(2) Date: Mar. 31, 2017

(87) PCT Pub. No.: WO2016/050586
PCT Pub. Date: Apr. 7, 2016

(65) Prior Publication Data

US 2017/0302015 A1 Oct. 19, 2017

(30) Foreign Application Priority Data

Oct. 2, 2014 (DE) ..... 10 2014 114 352

(51) Int. Cl.
*H01R 12/72* (2011.01)
*H01R 12/58* (2011.01)
*H01R 12/70* (2011.01)

(52) U.S. Cl.
CPC ..... *H01R 12/727* (2013.01); *H01R 12/58* (2013.01); *H01R 12/7005* (2013.01); *H01R 12/724* (2013.01)

(58) Field of Classification Search
CPC .. H01R 13/514; H01R 12/716; H01R 12/724; H01R 12/725; H01R 12/727; H01R 12/728; H01R 43/24
(Continued)

(56) References Cited

U.S. PATENT DOCUMENTS 4,067,637 A 1/1978 Narozny
4,553,801 A * 11/1985 Zajeski ..... H01R 12/716 439/350
(Continued)

FOREIGN PATENT DOCUMENTS

DE 89 10 765 U1 11/1989
DE 197 14 878 C1 8/1998
(Continued)

*Primary Examiner* — Ross Gushi
(74) *Attorney, Agent, or Firm* — Muncy, Geissler, Olds & Lowe, P.C.

(57) ABSTRACT

A male strip connector having a support element made of insulating material that has a base area section, a retaining section protruding transversely therefrom and, on the side of the retaining section that is opposite the base area section, a fixing section, and having a plurality of contact pins that have a plug contact section and a connection contact section angled off with respect thereto, is described. The retaining section has a plurality of insertion openings, arranged next to one another, for inserting a plug contact section of a contact pin. The fixing section has a plurality of recesses for holding a respective connection contact section of a contact pin. The retaining section has a plurality, corresponding to the number of insertion openings, of fingers that are separated from one another by free spaces and in which the insertion openings are made.

9 Claims, 9 Drawing Sheets

(58) Field of Classification Search
USPC ..... 439/937, 590
See application file for complete search history.

(56) References Cited

U.S. PATENT DOCUMENTS

| | | | | | |
|---|---|---|---|---|---|
| 4,641,908 | A * | 2/1987 | Steffinger | H01R 12/724 | 439/599 |
| 4,655,517 | A * | 4/1987 | Bryce | H01R 12/58 | 411/510 |
| 4,709,976 | A * | 12/1987 | Nakama | H01R 13/506 | 439/350 |
| 4,735,587 | A * | 4/1988 | Kirayoglu | H01R 12/58 | 439/751 |
| 4,832,622 | A * | 5/1989 | Zahn | B29C 45/0003 | 29/874 |
| 4,847,588 | A * | 7/1989 | Doutrich | H05K 3/308 | 439/751 |
| RE33,005 | E * | 8/1989 | Bryce | H01R 12/58 | 411/510 |
| 4,871,320 | A * | 10/1989 | Mouissie | H01R 13/506 | 439/598 |
| 4,900,276 | A * | 2/1990 | Doutrich | H05K 3/308 | 439/751 |
| 4,914,062 | A * | 4/1990 | Voltz | H01R 23/688 | 439/101 |
| 4,955,819 | A * | 9/1990 | Harting | H01R 12/712 | 29/213.1 |
| 5,108,317 | A * | 4/1992 | Beinhaur | H01R 13/405 | 264/274 |
| 5,141,453 | A * | 8/1992 | Fusselman | H01R 23/688 | 439/108 |
| 5,151,036 | A * | 9/1992 | Fusselman | H01R 23/688 | 439/108 |
| 5,199,886 | A | 4/1993 | Patterson | | |
| 5,242,311 | A * | 9/1993 | Seong | H01R 13/443 | 439/135 |
| 5,415,566 | A * | 5/1995 | Brunker | H01R 23/688 | 439/607.11 |
| 5,498,174 | A * | 3/1996 | Speer | H01R 12/716 | 439/567 |
| 5,571,022 | A * | 11/1996 | Schaarschmidt | H01R 43/205 | 439/135 |
| 5,613,864 | A * | 3/1997 | Northey | H01R 43/205 | 439/149 |
| 5,616,053 | A * | 4/1997 | Bogursky | B29C 45/0003 | 29/883 |
| 5,628,638 | A * | 5/1997 | Tojo | H01R 12/7005 | 439/590 |
| 5,655,914 | A * | 8/1997 | McCartin | H01R 12/57 | 439/374 |
| 5,733,148 | A * | 3/1998 | Kaplan | H01R 13/6456 | 439/680 |
| 5,785,536 | A * | 7/1998 | McCartin | H01R 12/57 | 439/374 |
| 6,146,181 | A * | 11/2000 | Plaza | H01R 9/2491 | 439/357 |
| 6,561,829 | B2 * | 5/2003 | Maeda | H01R 13/6315 | 439/247 |
| 6,592,382 | B2 * | 7/2003 | Wurster | H05K 3/366 | 439/82 |
| 7,234,951 | B2 * | 6/2007 | Wang | H01R 12/712 | 439/79 |
| 7,247,033 | B2 * | 7/2007 | Skowranek | H01R 12/75 | 439/709 |
| 7,309,241 | B2 * | 12/2007 | Ho | H01R 43/205 | 439/79 |
| 7,891,989 | B2 * | 2/2011 | Yash | H01R 13/516 | 439/79 |
| 7,988,504 | B2 | 8/2011 | Stromiedel | | |
| 2002/0192988 | A1 * | 12/2002 | Droesbeke | G01R 1/0433 | 439/70 |

FOREIGN PATENT DOCUMENTS

| | | |
|---|---|---|
| DE | 10 2005 024 732 A1 | 12/2006 |
| DE | 10 2009 035 716 B4 | 3/2014 |
| EP | 0 723 309 A2 | 7/1996 |
| EP | 0 747 998 A2 | 12/1996 |
| EP | 1 406 351 B2 | 1/2013 |

* cited by examiner

MALE STRIP CONNECTOR

This nonprovisional application is a National Stage of International Application No. PCT/EP2015/071882, which was filed on Sep. 23, 2015, and which claims priority to German Patent Application No. 10 2014 114 352.3, which was filed in Germany on Oct. 2, 2014, and which are both herein incorporated by reference.

BACKGROUND OF THE INVENTION

Field of the Invention

The invention relates to a male strip connector having a support element made of insulating material that has a base surface section, a retaining section projecting transversely therefrom and, on the opposite side of the retaining section from the base surface section, a fixing section, and having a plurality of contact pins that have a plug contact section and a connection contact section angled with respect thereto. The retaining section has a plurality of insertion openings, arranged next to one another, for inserting a plug contact section of a contact pin. The fixing section has a plurality of recesses for holding a respective connection contact section of a contact pin.

Description of the Background Art

Male strip connectors of this kind are used especially for connection to circuit boards, e.g. by soldering, press-fitting or insertion into a socket strip for the connection of plug connectors.

DE 10 2009 035 716 B4 discloses a plug connector suitable for and provided for a male strip connector of the type in question.

EP 0 747 998 A2 discloses a plug connector having a cover part and a male strip connector inserted into the cover part. The male strip connector has a base surface section with retention blocks composed of insulating material for respective pairs of contact pins. The adjacently arranged retention blocks merge into one another with latching grooves in between.

EP 1 406 351 B2 discloses a male strip connector having an insulating body, which is produced as an injection molding from plastic, and angled metal pins held therein. The insulating body rests by means of a base surface on a circuit board. The support legs of the pins project from the insulating body in substantially the same plane as the base surface.

U.S. Pat. No. 7,309,241 B2 shows a plug connector arrangement having a male strip connector and a female plug connector. The male strip connector has a plurality of angled contact pins installed in an insulating body. These are inserted into an insertion opening in the insulating body and into a recess respectively formed by two adjacently arranged projections. The insulating body has a roof surface above the angled contact pins. The insulating body has an engagement plate, extending parallel to the plug contact sections of the contact pins, for latching with a plug connector.

SUMMARY OF THE INVENTION

Taking this as a starting point, it is an object of the present invention to provide a male strip connector which is improved such that it is possible to shorten the male strip connector to the required length and required number of contact pins while reducing the risk of damage to the male strip connector.

For a male strip connector of the type stated at the outset, it is proposed that the retaining section has a plurality, corresponding to the number of insertion openings, of fingers, which are separated from one another by free spaces and in which the insertion openings are made. The base surface section has a plurality of platforms that corresponds to the number of insertion openings. The recesses in the fixing section are each formed by a collar. The adjacent fingers or the collars thereof of the adjacent recesses and/or the adjacent platforms are connected to one another by a web.

Thus, the support element formed from electrically insulating material is divided in each case into a region for a contact pin, wherein the individual sections can be separated from one another, by means of the free spaces between the fingers and the webs connecting the collars and/or platforms, at separation points formed thereby. By virtue of the fact that the contact pins are inserted by means of the plug contact sections thereof into insertion openings in the fingers and that the individual fingers and optionally also the platforms are separated from one another by free spaces, the support element breaks apart in the region of the free spaces when the support element is being divided into lengths without impairing the fastening of the contact pins on the retaining section. Likewise, the formation of the recesses in the fixing section for fixing the connection contact sections by collars and the interconnection of the adjacent collars by a web ensures that, when the support element is being divided into lengths, it does not break apart in the region of the recesses, e.g. in the region of the insertion openings, but in the region of the webs.

At the same time, it is ensured that the support element remains stable overall and holds the contact pins firmly. The contact pins could not only be pre-inserted at the factory but also inserted and snapped in in the required number into the support element by the user themselves, preferably after the support element has been reduced to the desired length.

The connection contact sections are suitable, for example, for soldered connection to a circuit board (e.g. by means of the through-hole soldering technique, surface-mounting soldering technique or the like), for press-fit connection to suitable mating contacts or for plug-in connection into suitable holders (e.g. socket strips).

It is particularly advantageous if the thickness of the webs is not as great as that of the platform. Not only does this provide a kind of predetermined breaking point in the region of the interspaces of the fingers and between the collars for the recesses. The base surface section divided into individual platforms can be separated from one another at defined separation lines by means of the webs, which form a kind of predetermined breaking point.

Moreover, these webs and the base surface section, which is contoured by means of the platforms, advantageously provide a plug-in contour which can be matched to a plug-in contour of a plug connector in order to ensure that a plug connector is plugged onto the male strip connector in a defined manner.

It is particularly advantageous if the fingers of the retaining section have side wall sections which adjoin the free spaces, wherein the side wall sections project from the plane of a respective surface section of the associated finger which is provided with the insertion opening. The surface sections having the insertion opening are thus offset relative to the width of the side wall sections, thus creating a free space. By means of the side wall sections, the fingers are stabilized and it is ensured that the support element is separated in the region of the interspace, adjoining the side wall sections, between the fingers when the male strip connector is shortened to the desired length.

Such shortening is possible not only with the aid of tools but also without tools.

The contact pins are preferably angled at a right angle, with the result that the plug contact section is at a right angle (with a tolerance of +/−10 degrees) to the connection contact section.

The connection contact sections of the contact pins can preferably be inserted with a press fit or, alternatively, with a snap-in/latching connection into the associated recesses in the fixing section. The dimensions of the recesses are thus preferably matched in such a way to the diameter of the insertion openings in the retaining section and the corresponding diameters of the plug contact sections of the contact pins that the connection contact sections are held positively and/or nonpositively in the associated recess by means of a press fit. In one embodiment of the male strip connector, a housing element, which has at least two side walls spaced apart from one another and a cover adjoining the side walls, can be provided. The support element then forms a bottom of the housing element, said bottom adjoining the side walls at a distance from the cover. This provides a male strip connector in which guidance for an associated plug connector is provided by the housing element even in the upper region that lies opposite the base surface section and in the lateral side region, said guidance preventing offset insertion or twisted insertion of a plug connector, for example. At the same time, the housing element is open at the front for the insertion of a plug connector. The front is the side toward which the free ends of the plug contact sections extend. A rear side wall can optionally be provided on the rear side of the housing element. The rear side is the side adjoining the fixing section, lying opposite the front side.

The housing element can be formed integrally with the support element. However, it is particularly advantageous if the housing element is embodied as a part which is separate from the support element and can be assembled with the support element. It is thus possible, if required, for a user to acquire a housing element additionally with a male strip connector of standardized length and to place the housing element on a support element, the latter being appropriately shortened if necessary.

In the variants described above, it is advantageous that the contact pins have a circular cross section. This facilitates snapping in and guidance of the contact pins into the support element. However, it is also conceivable that the contact pins have a quadrilateral, e.g. square or rectangular, cross section.

It is also conceivable that the plug contact sections have a contact projection. In particular, it is conceivable in this context that the insertion openings in the retaining section are open on one side for the insertion or snapping in of a contact pin and thus likewise form a kind of recess.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 9—shows a side view of the male strip connector with a plug connector plugged on;

FIG. 11—shows a perspective rear side view of the male strip connector with a plug connector plugged on;

DETAILED DESCRIPTION

Figure 1:
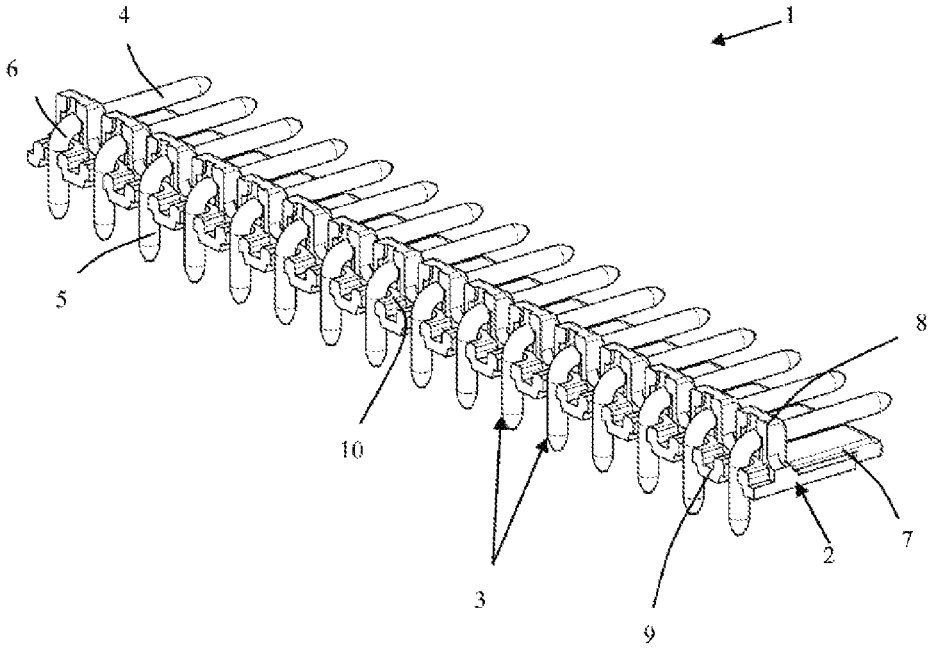
FIG. 1—shows a perspective rear side view of a male strip connector having a support element and contact pins.

FIG. 1 shows a perspective rear side view of a male strip connector 1, which is formed by a support element 2 and a plurality of contact pins 3. The support element 2 is manufactured from an electrically insulating material, e.g. from plastic. It is preferably produced by a plastics injection molding method. The electrically conducting contact pins 3 are inserted next to one another in a row into the support element 2. The contact pins 3 each have a plug contact section 4 and, at an angle thereto, a soldered contact section 5. The plug contact section 4 extends in a direction at an angle, preferably 90°+/−10°, to the direction of extent of the connection contact section 5 (e.g. soldered contact section, press-in contact section, plug-in contact section or the like). The plug contact sections 4 are provided for electrically conducting plug-contacting with an associated plug connector, which is plugged onto the male strip connector 1. In contrast, the connection contact sections 5, which extend transversely thereto and project by way of a kink or bend 6, are designed for insertion into a circuit board and soldering onto a circuit board, pressing into mating contacts or insertion into a socket strip. The free ends thereof can extend out from below the bottom plane of the support element 2. However, it is also conceivable that the connection contact sections 5 are folded over again and designed for soldered surface mounting (SMD soldering technique).

It becomes clear that the plug contact sections 4 of the plurality of adjacently arranged contact pins 3 create a common plug-in plane, which is defined by the direction of extent of the plug contact sections 4, on the one hand, and by the direction in which the adjacently arranged contact pins 3 are placed in a row, on the other hand. The connection contact sections 5, for their part, likewise create a plane, which is defined by the direction of extent of the connection contact sections 5 and the direction in which the adjacently arranged connection contact sections 5 are placed in a row.

The support element 2 is produced integrally, without joints, from an insulating material and has a base surface section 7, a retaining section 8, which projects transversely upward therefrom counter to the direction of extent of the connection contact sections 5, and a fixing section 9 in the rear region on the opposite side of the retaining section 8 from the base surface section 7. It becomes clear that the contact pins 3 are inserted by means of the plug contact sections 4 thereof into a respective insertion opening in the retaining section 8. They are fixed in the rear region to the fixing section 9 on the support element 2 by the insertion of the connection contact sections 5 into the respectively associated recesses 10.

Figure 2:
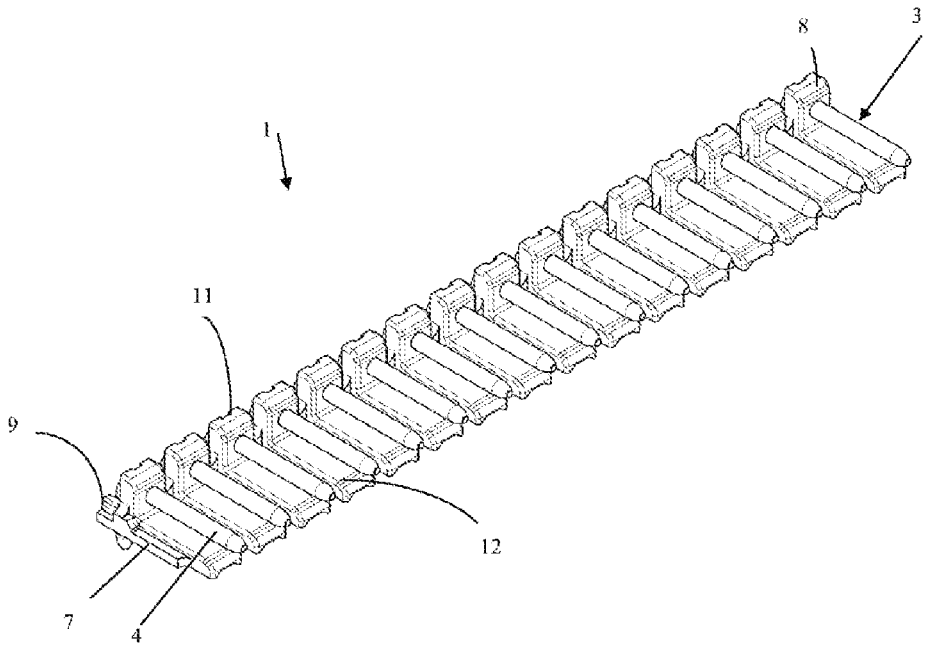
FIG. 2—shows a perspective front side view of the male strip connector from FIG. 1.

FIG. 2 shows a perspective front side view of the male strip connector 1 from FIG. 1. It becomes even clearer here that the plug contact sections 4 are each inserted into an associated finger 11 of the retaining section 8 and project forward with their free end from the respective finger 11. Here, the plug contact sections 4 are aligned parallel to the plane of the base surface section 7. The base surface section 7 is divided into individual platforms 12, each associated with one contact pin 3.

Figure 3:
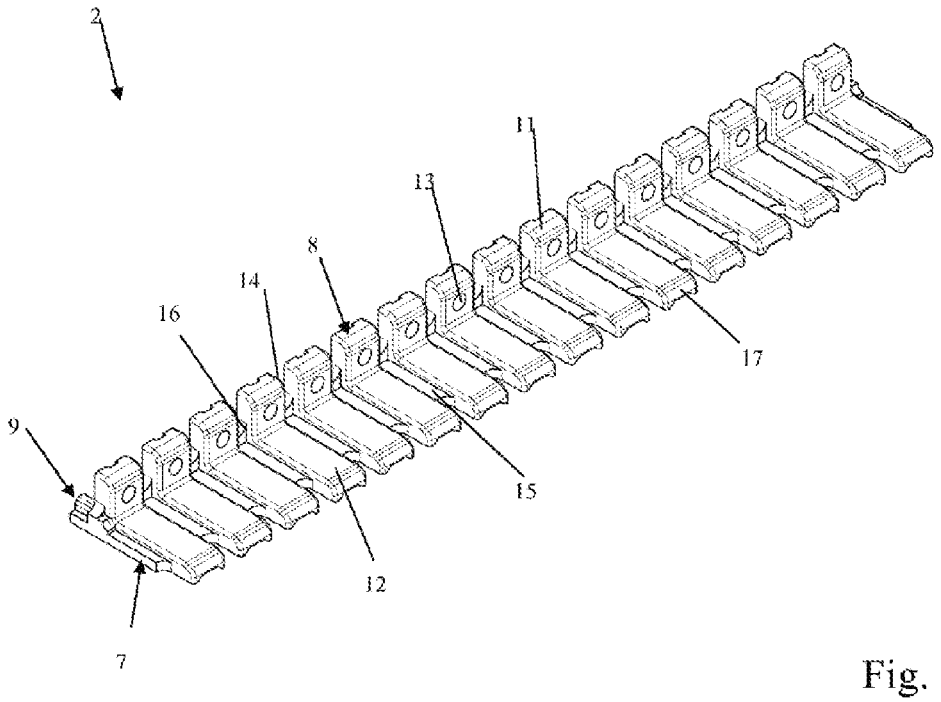
FIG. 3—shows a perspective front side view of the support element of the male strip connector from FIGS. 1 and 2.

FIG. 3 shows a perspective view of the support element 2 of the male strip connector 1 from FIGS. 1 and 2 without contact pins. It becomes clear that the fingers 11 of the retaining section 8, which are approximately quadrilateral in plan view, have insertion openings 13 to receive a respective contact pin 3 of each finger 11. It is also apparent that the adjacent fingers 11 are separated from one another by free spaces 14. The forward-pointing platforms 12 of the retaining section 7 adjoin the fingers 11 at a right angle. These platforms 7 are each connected to one another by webs 15. The webs 15 are shorter in length than the platforms 12 and, in the rearward part, merge into a web section 16, which projects perpendicularly thereto and connects two fingers 11 which are adjacent to one another. These webs 15 form predetermined breaking points, at which the support element 2 can be shortened to a desired length without tools by being broken off. If required, however, the male strip connector 1 can also be shortened to the required length with the aid of a tool, e.g. a knife.

It furthermore becomes clear that the platforms 12 have a curved surface 17 in the front region, making it easier to slide a plug connector on.

Figure 4:
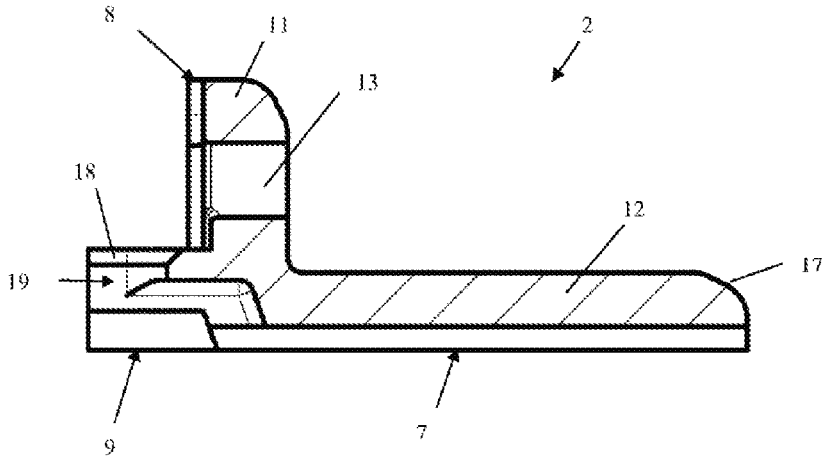
FIG. 4—shows a sectional view from the side of the support element from FIG. 3.

FIG. 4 shows a sectional view of the support element 2 from FIG. 3, from the side. It becomes clear from this that the insertion opening 13 in a finger 11 in each case has an insertion direction aligned parallel to the plane of the platform 12 adjoining said finger.

It furthermore becomes clear that, on the opposite side of the fingers 11 from a platform 12, a respective fixing section 9 projects in the opposite direction to the platform 12. Formed on the fixing section 9, behind each finger 11, is a respective collar 18, which forms a recess 19. These recesses 19 are each open from the side opposite the platform 12 in order to receive and retain a connection contact section of a pin contact 1.

Figure 5:
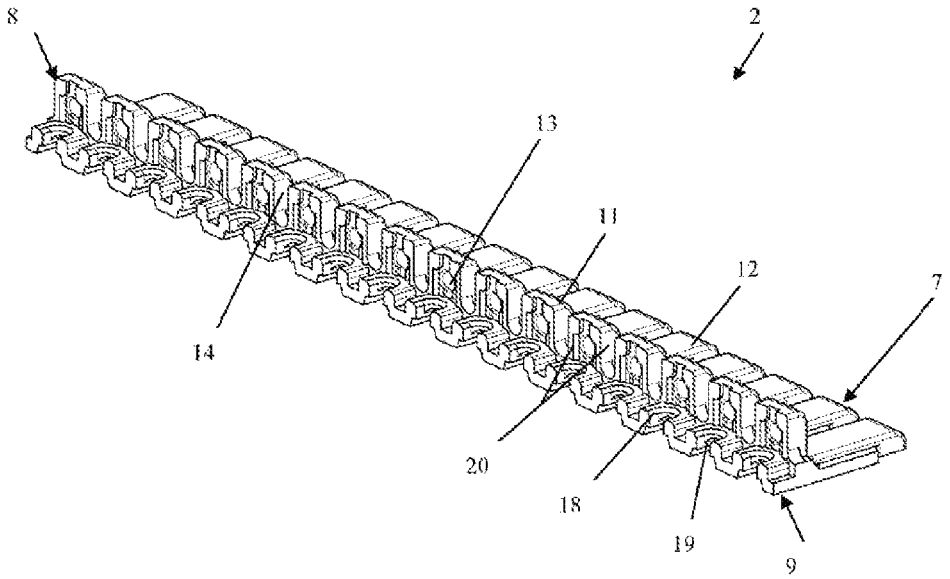
FIG. 5—shows a perspective rear side view of the support element from FIGS. 3 and 4.

FIG. 5 shows the support element 2 from FIGS. 3 and 4 in the perspective rear side view. It becomes clear here that a respective recess 19 is formed by a partially circular (e.g. semicircular) collar 18 on the rearward fixing section 9, opposite each platform 12 and adjoining a finger 11. The collar walls project into the region of the associated finger 11, which is recessed in the region of the insertion opening 13 in the illustrative embodiment shown. On the sides of the fingers 11 there are side wall sections 20, which adjoin the free spaces 14 between the fingers 11 and project rearward in the direction of the fixing section 9 from the plane of a surface section of the respective finger 11 provided with the insertion opening 13. In this way, a very stable structure of the finger 11 and of the platform 12 starting therefrom and of the fixing section 9 is achieved. Moreover, this also ensures that the intermediate webs 15 form a predetermined breaking point, at which the support element 2 can be reduced in length.

Figure 6:
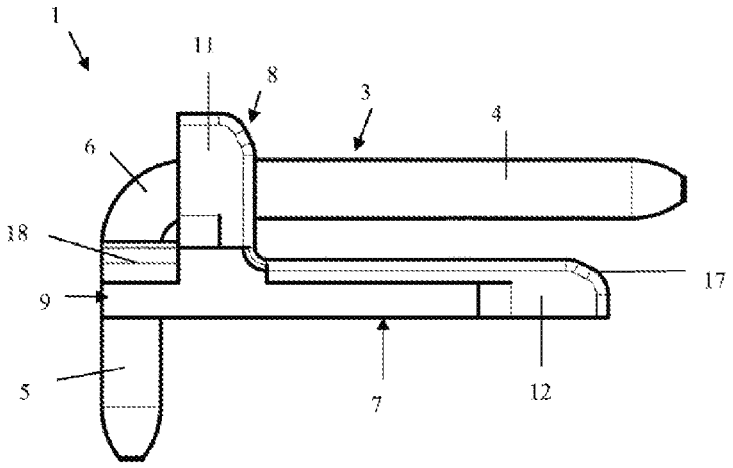
FIG. 6—shows a side view of the male strip connector from FIGS. 1 and 2.

FIG. 6 shows a side view of the male strip connector 1 from FIGS. 1 and 2. It becomes clear that the connection contact section 5 of a contact pin 3 is inserted into a recess 19, bounded laterally by a collar 18, of the rearward fixing section 9 and is preferably retained nonpositively with a press fit and/or positively. In contrast, the plug contact section 4 is pushed through an associated insertion opening 13 in the finger 11 and extends approximately parallel to the plane of the platform 12 situated below. The fingers 11 project perpendicularly from the plane formed by the platform 12 and the fixing section 9.

Figure 7:
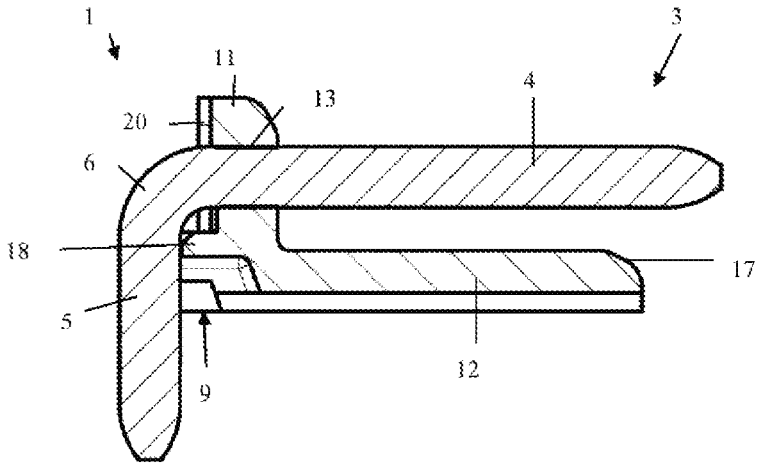
FIG. 7—shows a sectional view from the side of the male strip connector from FIG. 6.

FIG. 7 shows a sectional view from the side of the male strip connector 1 from FIG. 6. It is possible once again to see the insertion opening 13 in the finger 11, into which the plug contact section 4 of the contact pin 3 is inserted.

Also visible is one of the side wall sections 20 of the finger 11, which projects rearward from the plane of the surface section of the finger 11 in the direction of the fixing section 9, which is provided with the insertion opening 13. This surface section is the central, rearward region of the finger 11.

Figure 8:
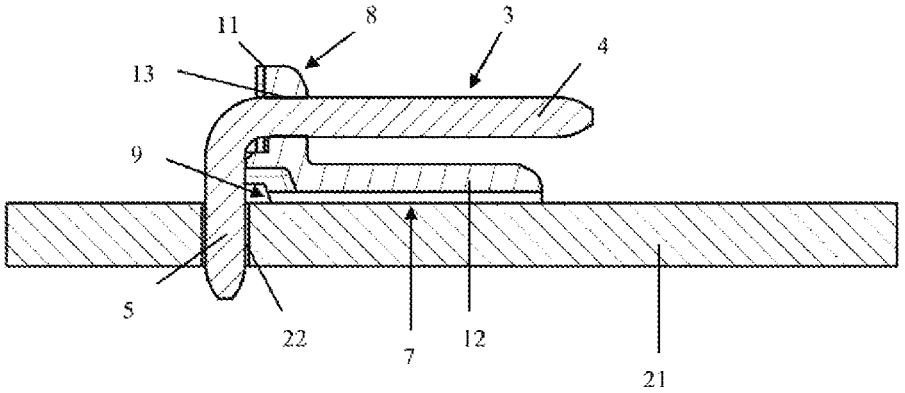
FIG. 8—shows a sectional view from the side of the male strip connector from FIG. 1 in the state in which it has been plugged onto a circuit board.

FIG. 8 shows a sectional view from the side of the male strip connector 1 from FIG. 7 in a state placed on a circuit board 21. Here, the connection contact sections 5 are inserted into holes 22 in the circuit board 21 and can preferably be soldered to the circuit board 21 on the rear side. For this purpose, there is, in a known manner, a metal surface surrounding the hole 22 on the rear side.

The platform 12 or the base surface section 7 and the fixing section 9 adjoining these are placed on the circuit board 21 on the upper side.

As an alternative to this embodiment, it is also conceivable for the connection contact section 5 to be bent over again in the opposite direction to the platform in the region of the lower plane of the base surface section 7 and to form a bearing surface on the upper side of the circuit board 21 for soldered surface mounting by the SMD soldering technique. It is then possible to dispense with a hole 22 in the circuit board 21.

Figure 9:
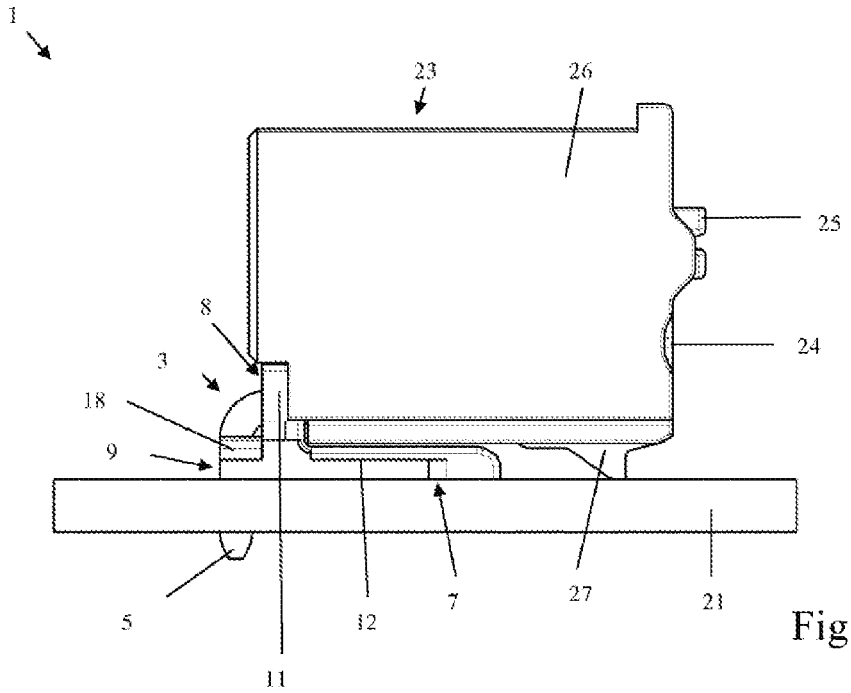

FIG. 9 shows a side view of the male strip connector 1 from FIG. 8 with a plug connector 23 placed thereon. Here, a plug connector 23 described in principle in DE 10 2009 035 716 B4 is shown by way of example, in which an electrical conductor inserted into the plug connector enters into direct connection with the associated plug contact section 4 of the contact pin 3 and is pressed against the plug contact section 4 by means of the clamping spring. For this purpose, there is a conductor insertion opening 24 on the front side for each contact pin 3. To open the clamping spring and the clamping point formed by the clamping spring, an actuating button 25 is installed in the insulating-material housing 26 of the plug connector 23 in such a way as to be accessible from the front side. In the forward region, the plug connector 21 rests by means of a foot element 27 on the circuit board 21. In the rearward region, the plug connector 23 rests on the platforms 12 of the male strip connector 1.

It furthermore becomes clear that, in the rearward region, the plug connector 23 has an offset, into which the fingers 11 of the retaining section 8 extend.

Figure 10:
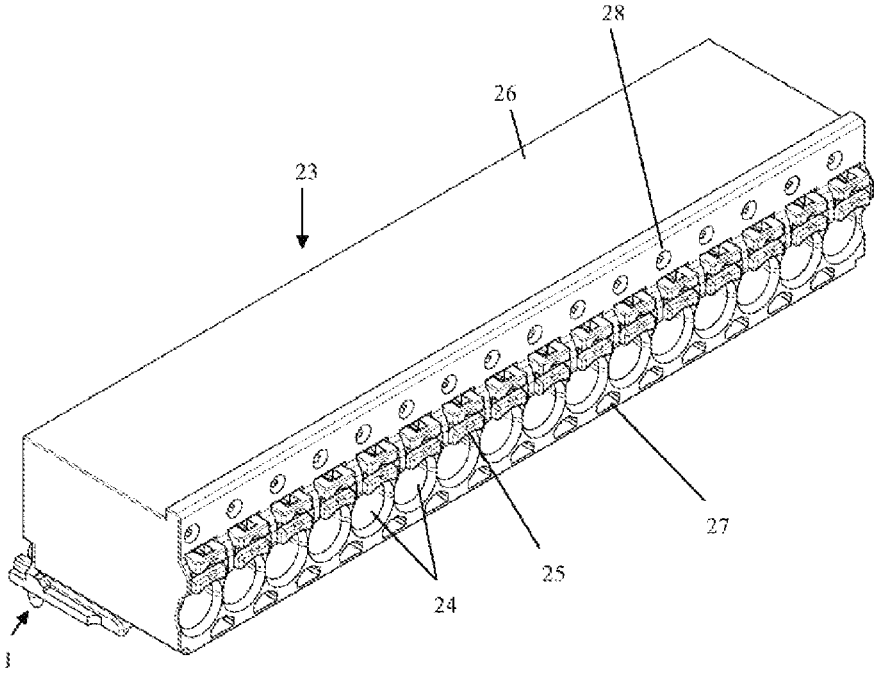
FIG. 10—shows a perspective view of the male strip connector with a plug connector plugged on from the front side.

FIG. 10 shows a perspective front side view of the male strip connector 1 with a plug connector 23 placed thereon. In the insulating-material housing 26, in the front side, there are adjacent conductor insertion openings 24, each associated with one contact pin, for receiving one electrical conductor in each case. Respective actuating buttons 25 are accommodated movably in the insulating-material housing 26 above the conductor insertion openings 24. These actuating buttons 25 interact in a manner known per se with an associated contact spring in the interior of the insulating-material housing 26, which spring presses an inserted conductor against a plug contact section 4 of a contact pin 3. Respective openings 27 for receiving grip- or cable-holding plates are introduced below the conductor insertion openings 24. Respective test openings 28, which lead to a respective clamp connection or to an associated clamping spring, are introduced above the actuating buttons 25. The electrically conducting potential can be measured there by inserting an electrically conductive test pin.

Figure 11:
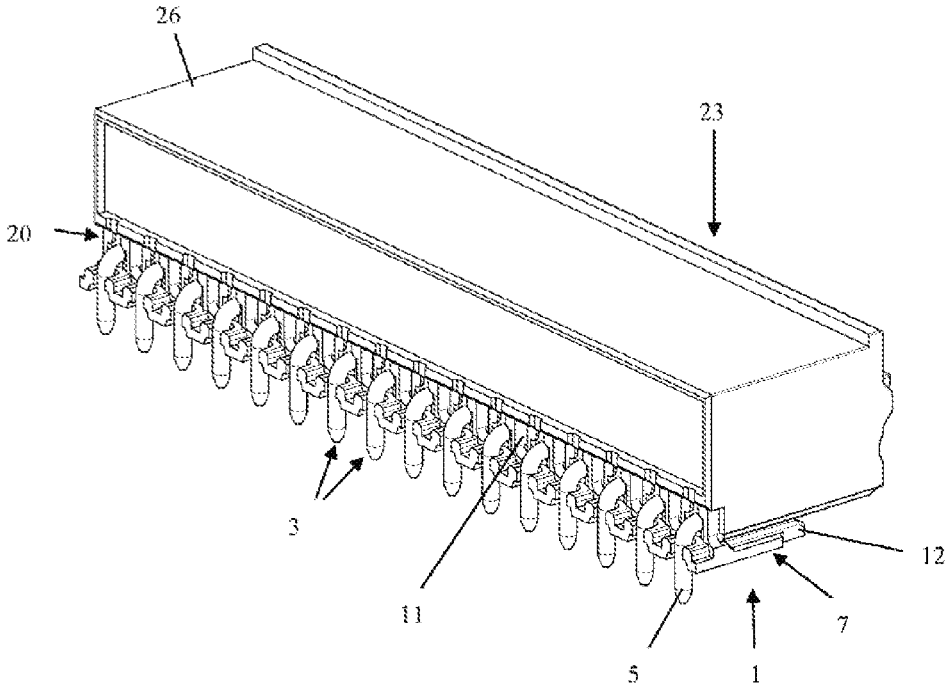

FIG. 11 shows the male strip connector 1 with the plug connector 23 placed thereon in the rear side view. It becomes clear here that the insulating-material housing 26 of the plug connector 23 overlaps the retaining section 8 in the rearward region since the fingers 11 of the retaining section extend into an offset in the insulating-material housing 26. The plug connector 23 is pushed onto the mutually adjacent contact pins 3 and rests on the platform 12 and possibly on the fingers 11.

In order then to adapt a standardized male strip connector 1 to the associated plug connector 23 with the number of poles of the plug connector 23, the standardized male strip connector 1 can be shortened in a simple manner without tools. For example, the illustrated standardized 16-pole male strip connector can be shortened to a 5-pole male strip connector for a 5-pole plug connector 23, for example, by breaking off five (5) platforms 12 at the adjoining web 15. The contact pins 3 can then be inserted or can also be supplied in advance in the already mounted state from the factory.

Figure 12:
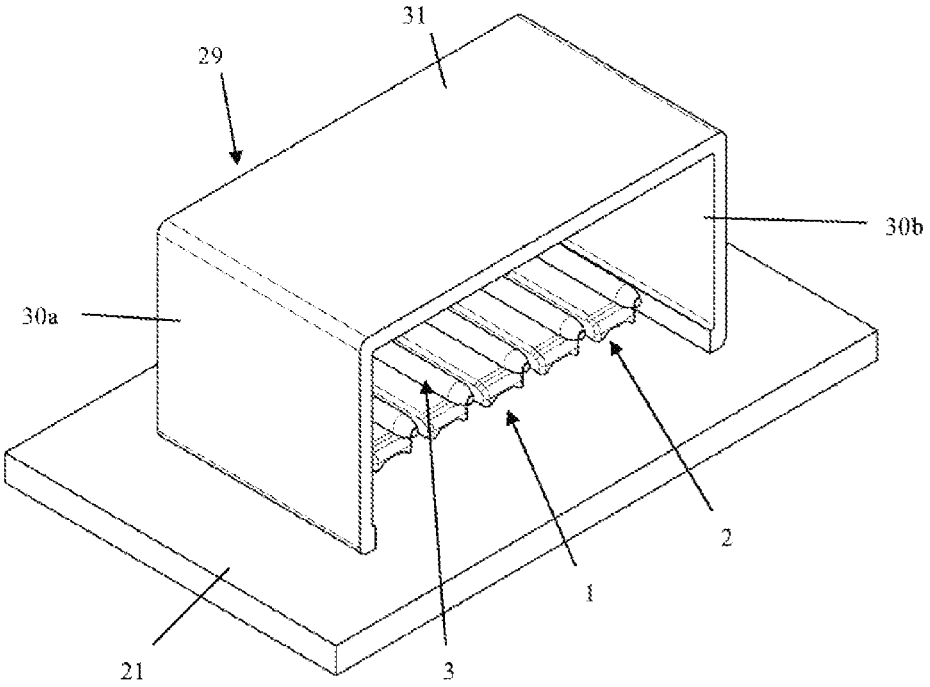
FIG. 12—shows a perspective view of a male strip connector plugged onto a circuit board, with an additional housing element.

FIG. 12 shows a modified embodiment of the male strip connector 1 described above. In this embodiment, there is an additional housing element 29, which is placed on a male strip connector 1. In the illustrative embodiment shown, the male strip connector is shortened to six poles. The housing element 29 has two mutually spaced and mutually opposite side walls 30*a*, 30*b* and, on the upper side, a cover 31 adjoining the side walls 30*a*, 30*b*. Like the male strip connector 1, the housing element 29 rests on a circuit board 21 in the installed state. It can be latched to the male strip connector 1 by means of suitable latching elements. However, it is also conceivable for a male strip connector 1 described above to be formed integrally and without joints with a housing element 29. In this case, the housing element 29 is formed without joints with a support element 2, e.g. by a plastics injection molding method. Like the support element 2, it is formed from an electrically insulating material.

Figure 13:
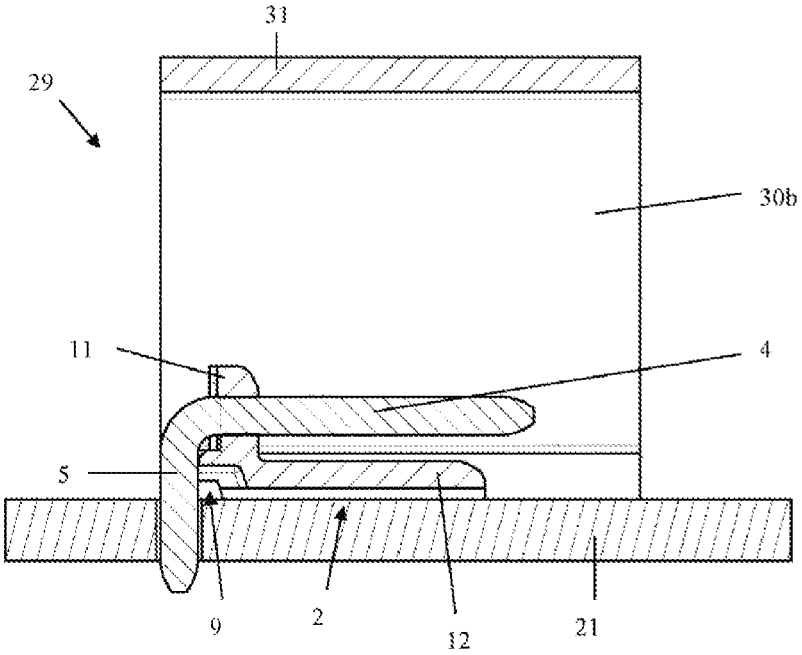
FIG. 13—shows a sectional view through the male strip connector with the housing element from FIG. 12, from the side.

FIG. 13 shows a sectional view through the male strip connector 1 with the housing element 29 from FIG. 12, from the side. It becomes clear here that the housing element 19 is open not only on the front side but also on the rear side. The length of the side walls 30*a*, 30*b* is greater than the length of the support element 2. The housing element 29 provides a space for accommodating a plug connector 23, which is inserted into the interspace of the housing element 29.

Figure 14:
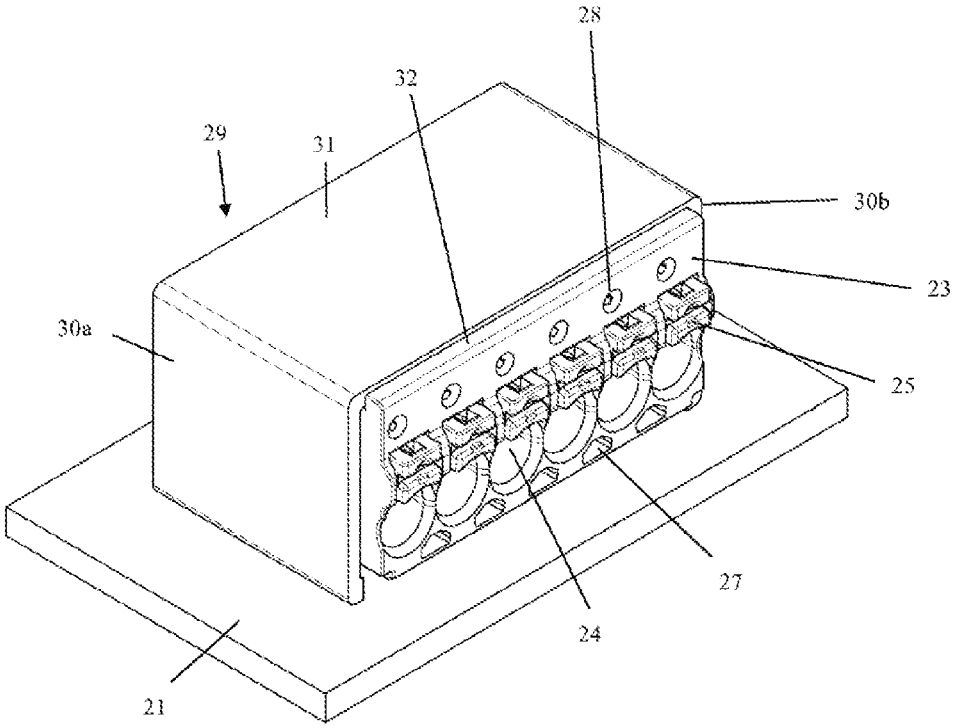
FIG. 14—shows a perspective front side view of the male strip connector with the housing element and the plugged-on plug connector.

This can be seen in FIG. 14, which shows a perspective view of the male strip connector 1 with the housing element 29 from FIGS. 12 and 13 with a plug connector 23 inserted. It becomes clear that the plug connector 30 is accommodated so as to be flush in the space enclosed by the housing element 29 and rests on the circuit board 21. In the upper region, the plug connector 23 has a collar 32, which abuts the front edge of the cover 31 in order to prevent pushing in further and to form a stop.

Figure 15:
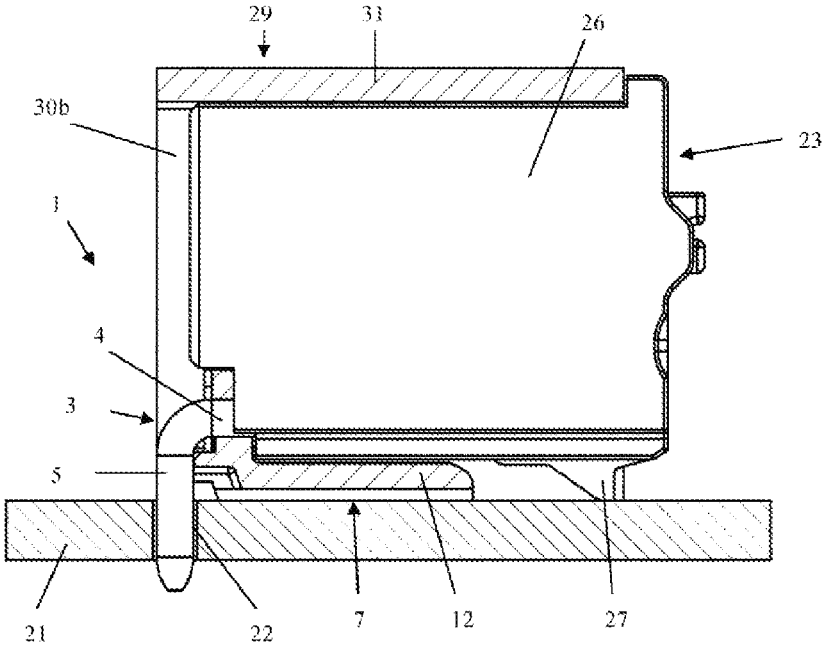
FIG. 15—shows a sectional view through the male strip connector with the plug connector and housing element from FIG. 14, from the side.

FIG. 15 shows a sectional view from the side of the male strip connector 1 with the housing element 29 and a plug connector 23 inserted. In this case, it becomes clear that the insulating-material housing 26 of the plug connector 23 adjoins the inside of the cover 31 so as to be flush therewith in the upper region. The side walls 30*a*, 30*b* extend as far as the connection contact sections 5 of the contact pins 3 and form a flush boundary at the side thereof. The plug contact 23 accommodated in the housing element 29 and plugged onto the male strip connector 1 rests on the platform 12 and the circuit board 21.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A male strip connector having comprising:

a support element made of insulating material that has a base surface section;

a retaining section projecting transversely therefrom and, on the opposite side of the retaining section from the base surface section;

a fixing section; and a plurality of contact pins that have a plug contact section and a connection contact section angled with respect thereto, wherein the retaining section has a plurality of insertion openings, arranged next to one another, for inserting a plug contact section of a contact pin, wherein the fixing section has a plurality of recesses for holding a respective connection contact section of a contact pin, wherein the retaining section has a plurality, corresponding to the number of insertion openings, of fingers, which are separated from one another by free spaces and in which the insertion openings are made, wherein the base surface section has a plurality of platforms that corresponds to the number of insertion openings, and wherein the recesses in the fixing section are each formed by a collar, wherein the collars of the adjacent recesses and/or the adjacent platforms are each connected to one another by a web.

2. The male strip connector as claimed in claim 1, wherein the thickness of the webs is not as great as that of the platforms.

3. The male strip connector as claimed in claim 1, wherein the fingers of the retaining section have side wall sections which adjoin the free spaces and which project from the plane of a surface section of the finger which is provided with the insertion opening.

4. The male strip connector as claimed in claim 1, wherein the contact pins are angled at a right angle.

5. The male strip connector as claimed in claim 1, wherein the connection contact sections can be inserted with a press fit into the associated recesses in the fixing section.

6. The male strip connector as claimed in claim 1, wherein a housing element, which has at least two side walls spaced apart from one another and a cover adjoining the side walls, wherein the support element forms a bottom of the housing element, said bottom adjoining the side walls at a distance from the cover.

7. The male strip connector as claimed in claim 6, wherein the housing element is formed integrally with the support element.

8. The male strip connector as claimed in claim 6, wherein the housing element is embodied as a part which is separate from the support element and can be assembled with the support element.

9. The male strip connector as claimed in claim 1, wherein the contact pins have a circular cross section.

* * * * *